US005763031A

United States Patent [19]

Huang

[11] Patent Number: 5,763,031

[45] Date of Patent: Jun. 9, 1998

[54] COVER REINFORCEMENT METHOD AND PRODUCT THEREOF

[76] Inventor: Jerry J. Huang, P.O. Box 940676, Plano, Tex. 75094

[21] Appl. No.: 788,412

[22] Filed: Jan. 27, 1997

[51] Int. Cl.[6] ..... B32B 1/08

[52] U.S. Cl. ..... 428/36.1; 139/384 R; 442/203

[58] Field of Search ..... 442/203; 428/36.1, 428/193; 139/384 R

[56] References Cited

U.S. PATENT DOCUMENTS

| | | | |
|---|---|---|---|
| 1,977,137 | 10/1934 | Moore . | |
| 2,021,993 | 11/1935 | Gutlon . | |
| 3,987,592 | 10/1976 | Herminghaus et al. . | |
| 4,298,645 | 11/1981 | Obayashi et al. | 428/110 |
| 4,590,715 | 5/1986 | Pandell | 52/3 |
| 5,419,376 | 5/1995 | Hawkins et al. | 139/384 R |
| 5,529,321 | 6/1996 | Thompson | 280/19 |

FOREIGN PATENT DOCUMENTS 40-4300-344A 10/1992 Japan .

*Primary Examiner*—James J. Bell
*Attorney, Agent, or Firm*—Richard C. Litman

[57] ABSTRACT

A reinforced tarpaulin cover and a method for producing the same which includes reinforced regions for the later applied grommets. Edges have extra fabric or fill added as well as stressed crossings between the grommet sites during the weaving process. The cover can vary in shape from circular to polygonal. The strength of the fabric is increased without significantly increasing the weight of the cover. A rope can be added under a rolled over edge or hem for greater edge strength. The cover can be coated with a colored flexible plastic composition.

20 Claims, 4 Drawing Sheets

COVER REINFORCEMENT METHOD AND PRODUCT THEREOF

BACKGROUND OF THE INVENTION

1. Field of the Invention

A grommeted tarpaulin sheet for covering materials is fabricated during the weaving process by reinforcing the edges and intermediate regions where grommets are to be located. The reinforcements are strips traversing the cloth fabric to increase the structural strength of the fabric for the intended use as tie-down tarpaulin sheets.

2. Description of Prior Art

The prior art describes the reinforcement of fabric by various means, but fails to address the problem of strengthening grommeted regions without tabs or added patches. Some of the prior art even teach against the use of grommets. The prior art will be discussed in the order of perceived relevance.

Japanese application Ser. No. 40-4300344 A published on Oct. 23, 1992, for Toyota Automat Loom Works, Ltd. (Yoshiharu Yasui) describes a three-dimensional woven fabric for enhancing the strength of a coupling part or tab which includes a grommet. The grommet region has a doubled weft layer which extends around the grommet and is reinforced with a radial yarn. The linear region extending from the grommet in the tab is reinforced with a vertical yarn arranged in the thickness region. However, the concern is the reinforcement of and weaving a tab around a grommet. Reinforcement between grommets in the sheet is not suggested.

Japanese application Ser. No. 40-2221436 A published on Sep. 4, 1990, for Toyota Automat Loom K.K. describes a similar three-dimensional cloth with tabs woven around an asymmetrical grommet. Again, the concern is the reinforcement of the tab around a grommet without any further reinforcement across the cloth cover.

U.S. Pat. No. 4,298,645 issued on Nov. 3, 1981, to Tsutomu Obayashi et al. describes a reinforced tarpaulin fabric having an additional thread of greater strength interwoven with the thicker cloth threads. The tarpaulin fabric can be coated with plastic and/or rubber. There is no suggestion for improving the strength locally around a grommet by additional yarn only at the grommeted locations.

U.S. Pat. No. 3,987,592 issued on Oct. 26, 1976, to Herminghaus et al. describes a plastic or fabric tarpaulin sheet reinforced with perforated plastic edge strips, which are welded, glued or sewn onto one side or both sides of the sheet. Some of the blind holes of the cloth are selectively punched through to provide holding eyes at desired locations. There is no suggestion for reinforcement of the holding eyes with yarn during the knitting process.

U.S. Pat. No. 5,419,376 issued on May 30, 1995, to Kevin Hawkins et al. describes a woven grommet structure for canvas-like materials for awnings for holding awning retaining ropes. A woven fabric strip having central reinforcing spine is defined by paired high tensile strength warp yarns to form a series of mutually spaced apart attachment apertures. The fabric is intended as a substitute for grommets.

U.S. Pat. No. 2,021,993 issued on Nov. 26, 1935, to Sidney S. Gutlon describes a woven fabric which is reinforced in transverse stripes. Vertical stripes can be added for a fabric to be used for curtains or window shades. There is no suggestion for reinforcing the fabric for grommets.

U.S. Pat. No. 1,977,137 issued on Oct. 16, 1934, to Thomas F. Moore describes a buttonhole fabric wherein rubber cords for the buttonholes are incorporated in the fabric. There is no suggestion for reinforcing the fabric for grommets.

U.S. Pat. No. 4,590,715 issued on May 27, 1986, to Nestor W. Pandell describes a tarpaulin which is edge-finished for a single line tie-down. The edge contains a series of semi-circular cutouts of the conduit containing the line. The exposed line is then utilized for anchoring the tarpaulin. Grommets are eliminated.

U.S. Pat. No. 5,529,321 issued on Jun. 25, 1996, to George R. Thompson describes a tarpaulin harness draft and equalizer assembly for loading and hauling garden refuse. The tarpaulin sheet is grommeted at doubled edges at only the front (pulling) edge and the rear (dragging) edge. The front corners are doubled. A central double layer patch reinforces the central grommet. The tarpaulin is harnessed to a tow bar and dragged by a tractor. The reinforcement of the grommeted regions is done by adding patches or doubling the tarpaulin to tie two grommets. There is no suggestion for reinforcement during the knitting process for grommeting.

None of the above inventions and patents, taken either singularly or in combination, is seen to describe the instant invention as claimed. Thus a cover reinforcement solving the aforementioned problems is desired.

SUMMARY OF THE INTENTION

The present invention relates to a method of making a reinforced tarpaulin cover and the product thereof which includes reinforced regions for the later applied grommets. Extra fabric or fill is added to the edge as well as stressed crossings between the grommet sites during the weaving process. The strength of the fabric is increased without significantly increasing the weight of the cover. The reinforced cover can have various shapes including a circular or polygonal shape. A rope can be added at the edge under a rolled over edge or hem for greater edge strength. A flexible plastic coating can be applied over the yarn of the cover with or without hemmed edges.

Accordingly, it is a principal object of the invention to weave a reinforced fabric cover which can be subsequently grommeted.

It is another object of the invention to reinforce the fabric cover at all edges with a fill of weft and warp threads.

It is a further object of the invention to strengthen the stressed crossings between the grommet sites without significantly increasing the weight of the cover.

Still another object of the invention is to produce various shapes of the grommeted cover with reinforced regions.

It is an object of the invention to provide improved elements and arrangements thereof in a cover reinforcement method and product for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
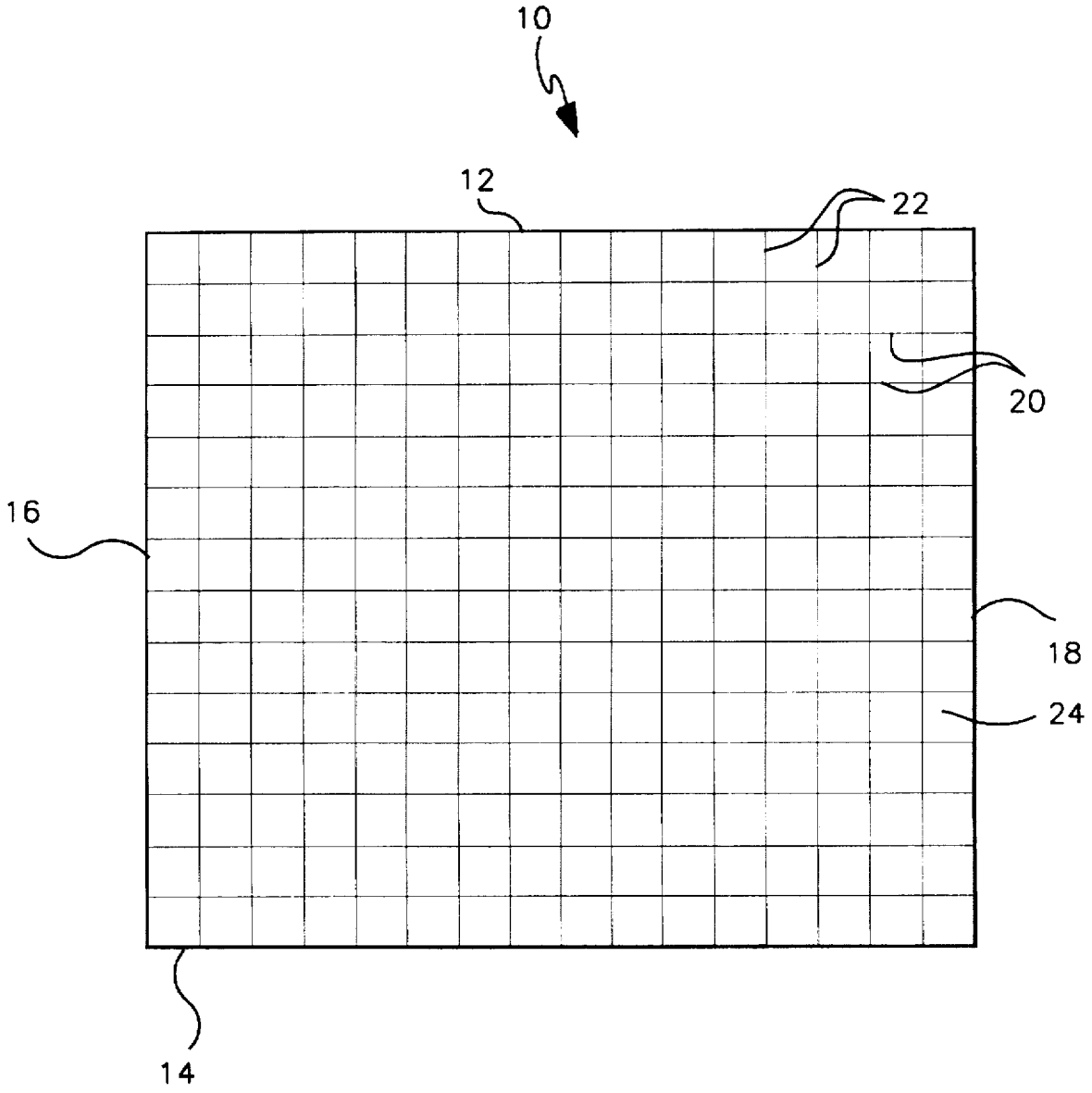
FIG. 1 is a plan view of a cover sheet of a first embodiment without reinforcement in a first step in the process of producing the reinforced cover sheet according to the present invention.
Figure 2:
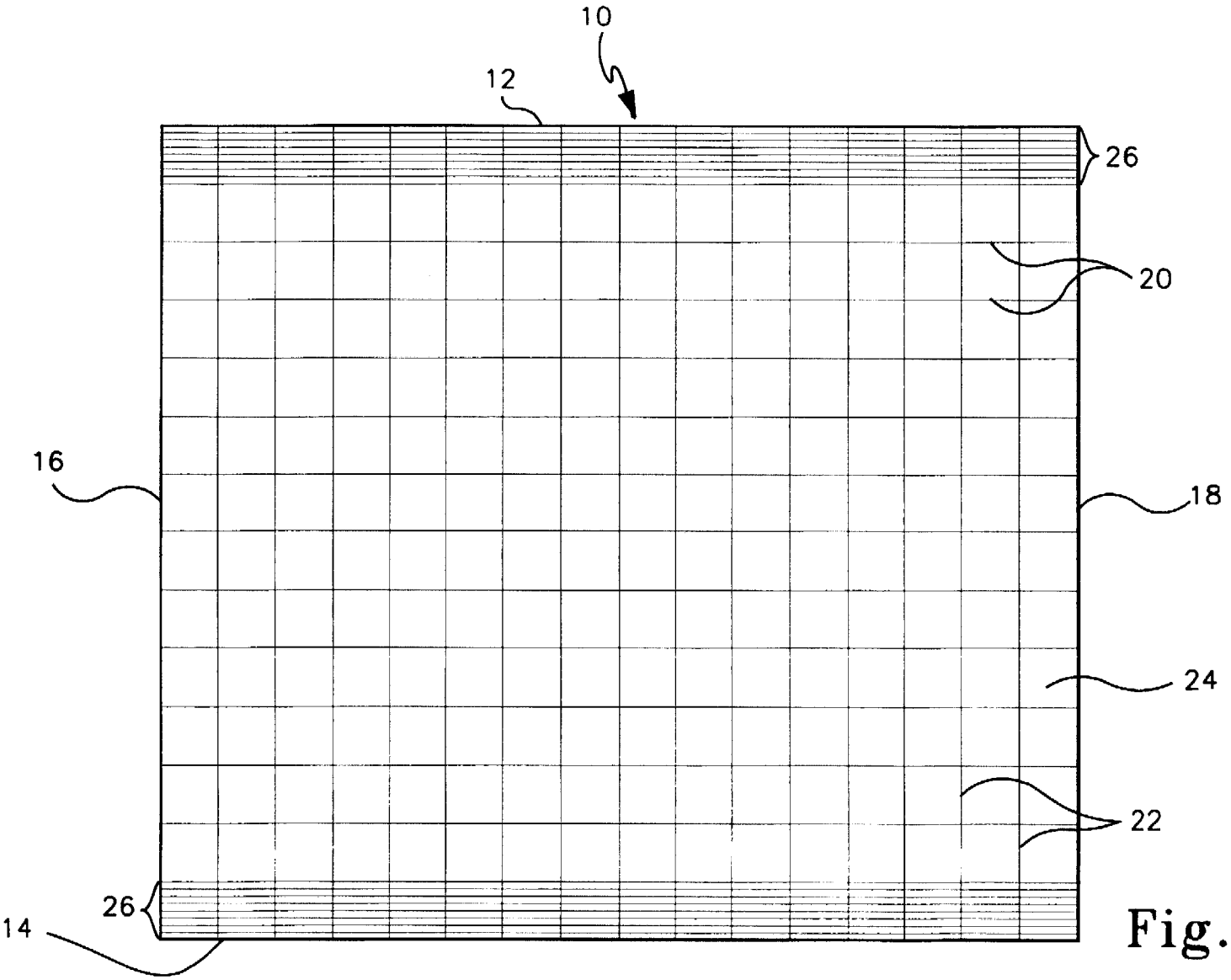
FIG. 2 is a plan view of the first reinforcing step showing additional weft threads along the horizontal edges of the cover sheet.
Figure 3:
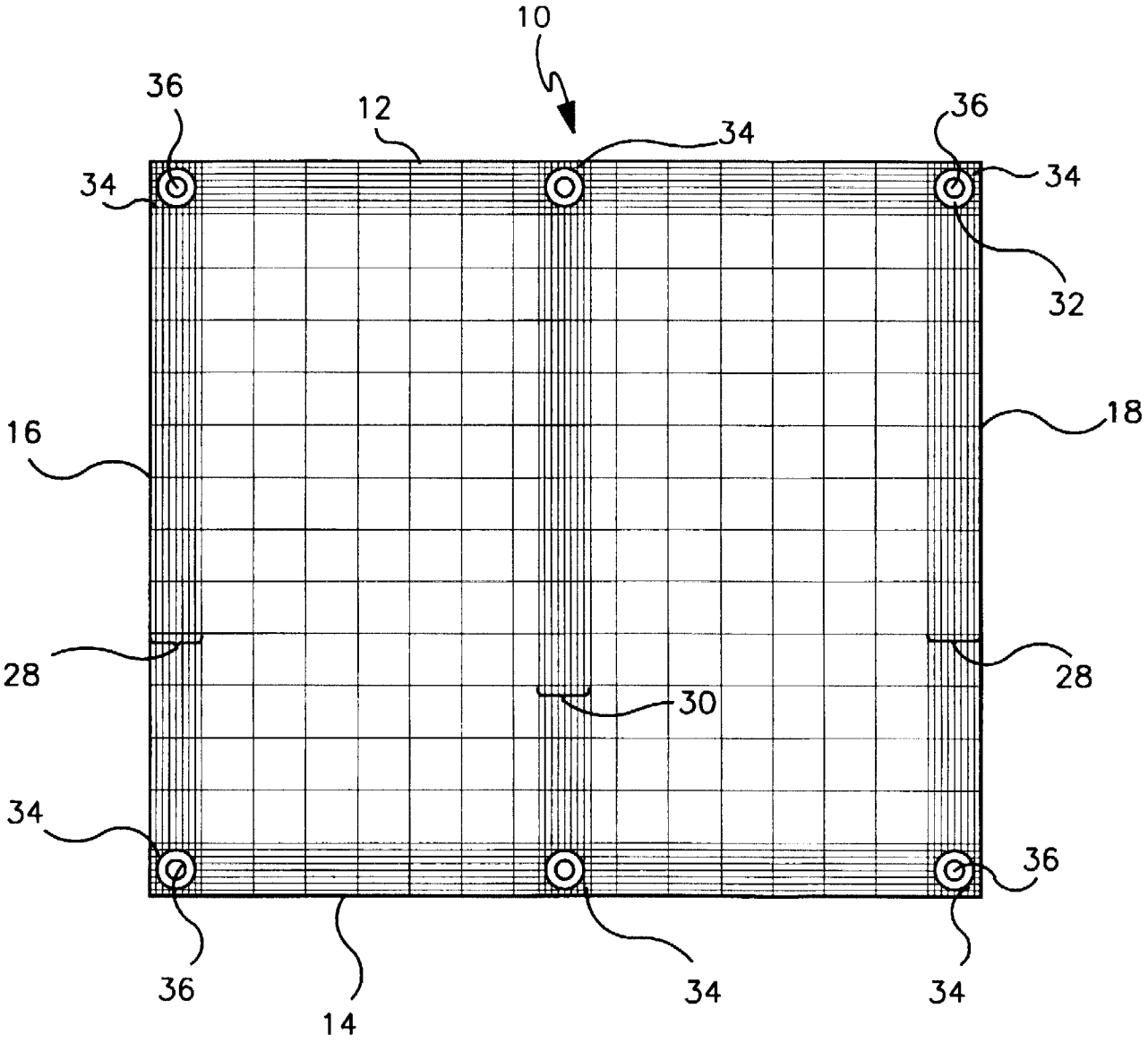
FIG. 3 is a plan view of the second reinforcing step to add additional warp threads vertically and the insertion of the grommets at the corners and intermediate locations of the reinforced cover sheet.

In the first embodiment illustrated in FIGS. 1–3, the fabrication of the polygonal cover sheet 10 is shown in sequence. The weaving is actually performed in a sequence from the top edge region 12 to the bottom edge region 14 of the sheet 10, and from the left edge region 16 to the opposite right edge region 18 and back to the left edge region 16 as manufactured by a weaving machine or loom. The computerized loom is programmed to weave weft or woof threads 20 horizontally back and forth across the vertical or lengthwise warp threads 22 to form squares 24 as seen in FIG. 1. It should be noted that the space between warp and weft threads is exaggerated for purposes of illustration.

FIG. 2 illustrates the addition of seven threads of weft fill 26 along the horizontal top and bottom edges 12, 14, respectively, as the initial reinforcement of the aforementioned edges. (Eight fills are seen, as the first is there before the seven are added.) The weaving steps of FIGS. 2 and 3 are actually combined so as to form the reinforced weft fills 26 on the loom as the weaving progresses from the top edge 12 to the bottom edge 14. The number of fill threads is exemplary and can vary according to the spacing if any is desired. However, this weaving step does not require intricate three-dimensional interweaving to add strength to the fabric as was seen in the prior art.

FIG. 3 illustrates a combination of the next two sequential process steps. The second process step involves the addition of warp fills 28 in the form of seven additional warp threads at the left and the right edges 16 and 18 of the cover sheet 10 as well as a six warp thread fill 30 in the center distributed equally as three warps on either side of the original warp thread 22. Again, the actual number of added warp threads 30 is exemplary and would depend on the sizes of the squares 24 and the threads. Although only one intermediate reinforcement has been depicted, it should be understood that another set or sets of warp threads 30 can be added as well as one or more sets of weft fills 26 depending on the size and configuration of the cover sheet 10.

At this stage, it should be recognized that the grommets 32 will be located in regions 34 wherein the weft fills 26 have been reinforced with warp fills 28 or 30. The second process step requires the punching of holes 36 for the addition of grommets 32 in regions 34, either mechanically or automatically.

Figure 4:
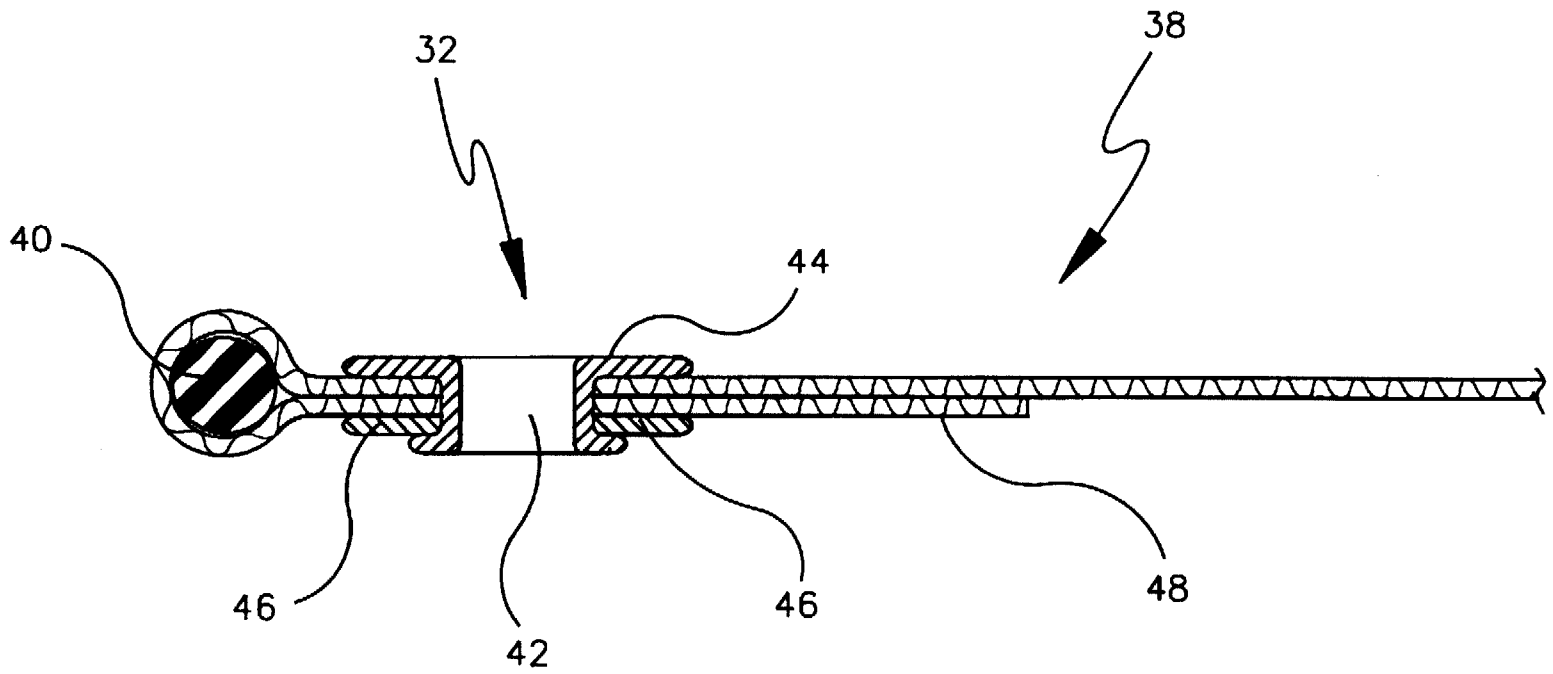
FIG. 4 is a sectional view of a second embodiment wherein a rope is inserted in the hemmed region of a cover sheet partially shown before grommeting.

Turning to the sectional view of FIG. 4 and a second embodiment of the present invention, a woven sheet 38 is folded over at one or more edges and hemmed to include a rope 40 and then grommeted at selective sites which have been filled in. Holes 42 are punched and grommets 32 are attached with the primary portion 44 engaging the secondary plate portion 46. The rope 40 strengthens the edges 12, 14, 16, and 18 (FIG. 1). The doubled edge 48 provides greater strength to the grommeted regions.

The woven sheets 10 and 38 can be coated with a flexible plastic coating for providing greater strength and resistance to weather conditions. Regular duty tarpaulins woven with high-density polyethylene thread can be coated with a colored composition of low-density polyethylene, e.g., silver, blue, etc. to form an impervious cover for regular duty. However, heavy duty use such as for covering truck loads, heavy-duty polyethylene threading without any plastic coating is preferable. The thread size/weight can range from 510–2000 Daniel. For edges, 1000 Daniel thread can be used for a cover made from 510 Daniel thread. The reinforcement by weaving can be limited to only two parallel edges for a rectangular cover as depicted in FIG. 2.

Examples of suitable mesh size and reinforcement mesh size (in brackets) per square inch are as follows: (a) 5×5 (10×10); (b) 8×8 (14×14); (c) 14×14 (20×20); (d) 14×16 (20×20). Covers with mesh sizes (b) and (c) are preferred. The range of cover sizes can range from 4 ft. square to 20 ft. square. However, it is contemplated that the present invention can be adapted to produce various cover shapes ranging from polygonal (triangle, square, rectangle, pentagon, hexagon, etc.) to circular (circle, ellipse, etc.). The grommets can be either aluminum or steel.

The object has been to provide a unique tabless tarpaulin cover with reinforced regions for grommets and locations between grommets across the cover to resist the stresses applied during tie-downs without adding significantly to the increase in weight and cost of producing a durable grommeted cover.

It is to be understood that the present invention is not limited to the embodiments described above, but encompasses any and all embodiments within the scope of the following claims.

I claim:

1. A reinforcement for a polygonal grommeted fabric cover comprising:

a polygonal woven fabric having corners with a yarn base of spaced weft and warp;

a reinforcement along all edges of said polygonal fabric with an additional fill of weft and warp; and metal grommets at at least each corner;

whereby the grommeted and reinforced fabric cover resists tearing of the fabric cover at the grommeted areas during tie-downs.

2. The cover reinforcement according to claim 1, including at an intermediate location between corners at least one additional fill of yarn reinforcement which traverses said polygonal fabric and receives corresponding grommets at the edges of the cover.

3. The cover reinforcement according to claim 2, wherein the edges of said polygonal woven fabric with the reinforcement of the additional fill of weft and warp are hemmed prior to the addition of grommets.

4. The cover reinforcement according to claim 3, wherein said hem contains a rope.

5. The cover reinforcement according to claim 1, wherein the polygonal cover has a rectangular shape.

6. The cover reinforcement according to claim 1, wherein the polygonal cover has a square shape.

7. The cover reinforcement according to claim 1, wherein the polygonal cover has a triangular shape.

8. The cover reinforcement according to claim 1, wherein the polygonal cover has a pentagonal shape.

9. The cover reinforcement according to claim 1, wherein the polygonal cover has a hexagonal shape.

10. The cover reinforcement according to claim 1, wherein the cover has a colored coating of flexible plastic.

11. A reinforcement for a circular grommeted fabric cover comprising:

a circular woven fabric having a yarn base of spaced weft and warp;

a reinforcement along the edge of said circular fabric with an additional fill of weft; and metal grommets at predetermined locations equidistant from each other at the edge;

whereby the grommeted and reinforced fabric cover resists tearing of the fabric cover at the grommeted areas during tie-downs.

12. The cover reinforcement according to claim 11, wherein the edge of said circular woven fabric with the reinforcement of the additional fill of weft is hemmed prior to the addition of grommets.

13. The cover reinforcement according to claim 12, wherein said hem contains a rope.

14. The cover reinforcement according to claim 11, wherein said circular cover is a circle.

15. The cover reinforcement according to claim 11, wherein said circular cover is an ellipse.

16. The cover reinforcement according to claim 11, wherein said circular cover has a flexible plastic coating.

17. A method of reinforcing a grommeted cover comprising:

providing a polygonal woven fabric having corners with a yarn base of evenly spaced weft and warp;

providing a reinforcement along all edges of said polygonal fabric with an additional fill of weft and warp; and adding metal grommets at each corner;

whereby the grommeted and reinforced fabric cover resists tearing of the fabric cover at the grommeted areas during tie-downs.

18. The method according to claim 17, wherein predetermined intermediate locations between corners are reinforced by an additional fill of weft and warp traversing the cover for additional insertion of metal grommets.

19. The method according to claim 17, wherein a rope is included at the edges and covered by hemming after the step of reinforcement by the additional fill of weft and warp, and before the step of grommeting.

20. The method according to claim 17, wherein the reinforced fabric is coated with a flexible plastic film before the step of grommeting.

* * * * *